US005275413A

United States Patent [19]

Sprague

[11] Patent Number: 5,275,413

[45] Date of Patent: Jan. 4, 1994

[54] GOLF CLUB WITH SUPPLEMENT PORTION

[76] Inventor: Tom Sprague, 3214 NE. 108th St., Vancouver, Wash. 98686

[21] Appl. No.: 991,955

[22] Filed: Dec. 17, 1992

[51] Int. Cl.[5] ..... A63B 53/04; A63B 69/36

[52] U.S. Cl. ..... 273/194 B; 273/164.1; 273/171; 273/173

[58] Field of Search ..... 273/193R, 194R, 194B, 171, 172, 173, 174, 167F, 169, 77R, 164.1, 79

[56] References Cited

U.S. PATENT DOCUMENTS

| | | | |
|---|---|---|---|
| 1,674,136 | 6/1928 | Shidler | 273/172 |
| 2,332,342 | 10/1943 | Reach | 273/171 |
| 2,503,506 | 4/1950 | Miller | 273/194 A X |
| 3,220,733 | 11/1965 | Saleeby | 273/164.1 X |
| 3,333,854 | 8/1967 | White | 273/173 X |
| 3,419,275 | 12/1968 | Winkleman | 273/194 B X |
| 3,578,332 | 5/1971 | Caldwell | 273/78 X |
| 3,727,920 | 4/1973 | Scott | 273/194 A X |
| 3,912,277 | 10/1975 | Pelz | 273/194 B X |
| 4,121,832 | 10/1978 | Ebbing | 273/173 X |
| 4,199,144 | 4/1980 | Skelly | 273/164.1 |
| 4,844,468 | 7/1989 | Lee | 273/194 B X |
| 4,852,879 | 8/1989 | Collins | 273/164.1 |
| 5,062,639 | 11/1991 | Hitt | 273/194 B X |
| 5,230,509 | 7/1993 | Chavez | 273/171 |

*Primary Examiner*—Vincent Millin
*Assistant Examiner*—Sebastiano Passaniti
*Attorney, Agent, or Firm*—Kolisch, Hartwell, Dickinson, McCormack & Heuser

[57] ABSTRACT

A putter having a head supplement portion detachably mounted on the back of the head in the putter. Mortise and tenon structure interconnects the supplement portion and putter head. Screw fasteners engage anchor projections in the mortise and tenon structure to hold the supplement portion in place.

4 Claims, 1 Drawing Sheet

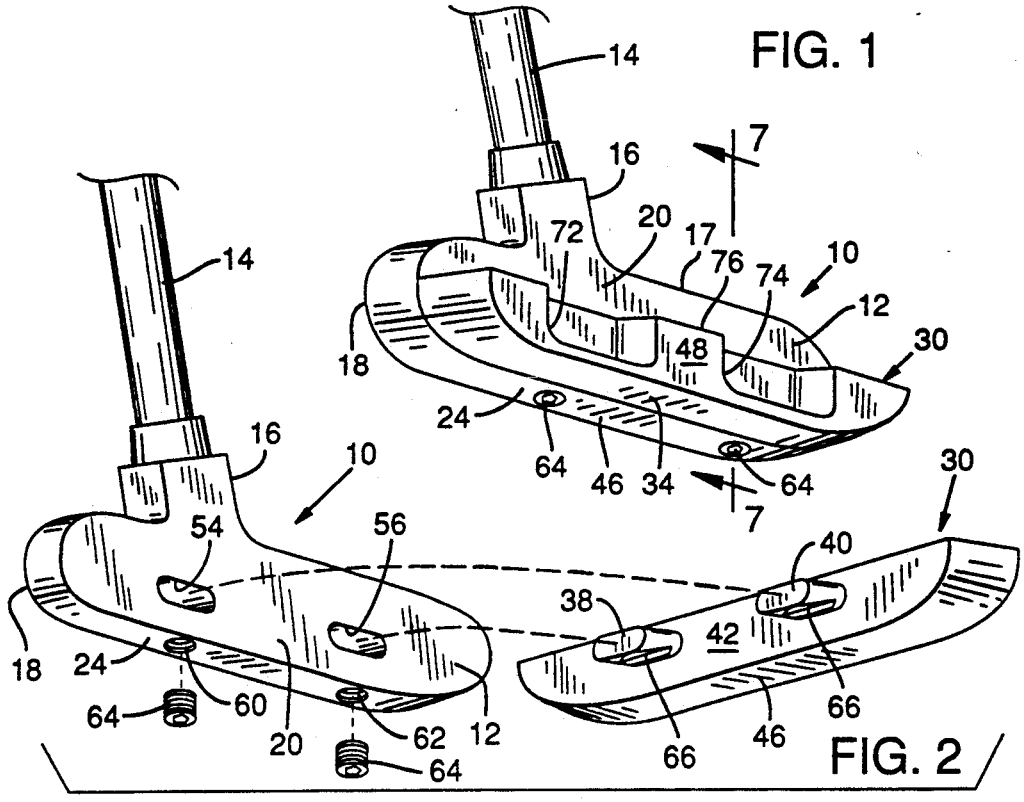
FIG. 1
FIG. 2
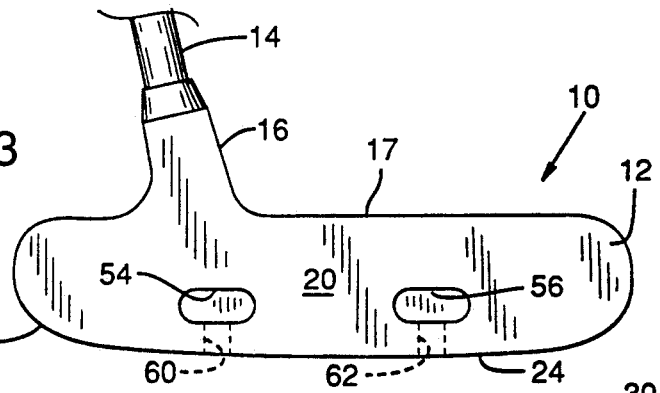
FIG. 3
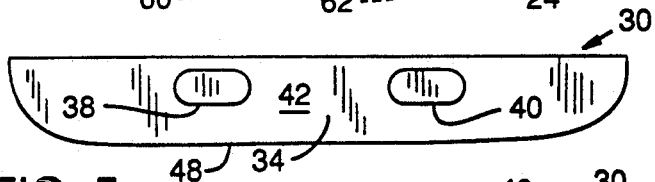
FIG. 4
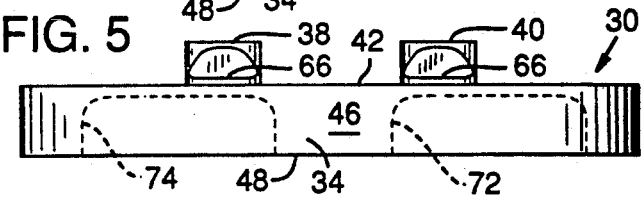
FIG. 5
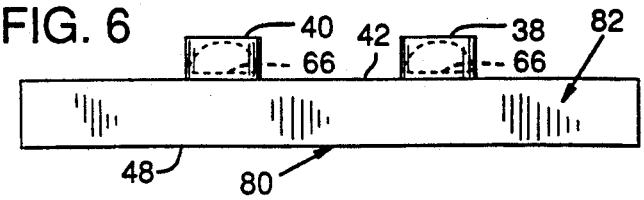
FIG. 6
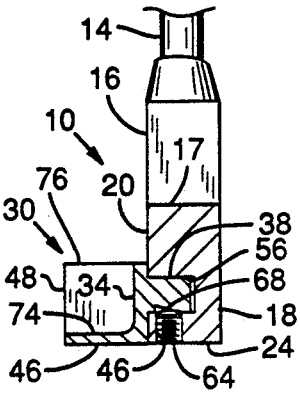
FIG. 7

GOLF CLUB WITH SUPPLEMENT PORTION

BACKGROUND AND SUMMARY OF THE INVENTION

This invention relates to a golf club, and more particularly to a golf club such as a putter where it may be advantageous for various reasons to be able to change the weight, appearance, feel, etc. of the club.

The putting stroke is a highly individualistic thing. There are numerous types of grips and swings employed by golfers, all adopted best to suit the particular golfer's objective of stroking the ball into the hole. The weight and feel of the putter, as well as the appearance of the putter (affecting golfer confidence) are also subject to variation. For instance, some prefer a heavier club than others. Some putters have a wider and more substantial bottom than others, with some golfers feeling that a large bottom surface enables a club best properly to position itself on the ground. Even when considering the same golfer, there are advantages in being able to change the character of the club with respect to its weight, swing and feel. For instance, changeability permits a golfer easily to make adjustments tending to establish what type of club best suits his particular needs. With some golfers, a slicker green surface might dictate one type of club, whereas the same golfer with a slower green might desire a different type of club.

A general object of this invention is to provide a golf club which includes a detachable portion detachably mounted on the back side of the head in the club which may be removed from the head and which on removal may be replaced with a differently configured detachable portion to change a characteristic of the club, such as its feel or weight.

More specifically, an object is to provide such a club, which in the embodiment of the invention herein disclosed constitutes a putter, with a detachable head supplement portion, and a mortise-and-tenon type of construction which establishes a properly mounted position for the head supplement portion on the putter head.

In a specific embodiment of the invention, the mortise and tenon construction comprises one or more anchor projections integral with a body in the head supplement portion that fit within respective wells provided in the back side of the putter head. The anchor projections and the wells establish a proper relationship of the supplement portion on the putter head, for instance, with a base surface in the supplement portion forming a smooth continuation of a bottom surface on the putter head. Further, the projecting anchor portions may be employed in establishing a locked mounting of the supplement portion on the head, through screws or fasteners which engage the projections to produce a secure attachment.

BRIEF DESCRIPTION OF THE DRAWINGS

These and other objects and advantages are attained by the invention, which is described hereinbelow in conjunction with the accompanying drawings, wherein:

FIG. 1 is a perspective view, illustrating portions of a golf club, more specifically the head of a putter, with a head supplement portion as contemplated herein secured to the back side of the head;

FIG. 2 illustrates, in a perspective view, how the supplement portion may be removed;

FIG. 3 illustrates the back side of the putter head;

FIG. 4 is a view looking at the front side of the head supplement portion;

FIG. 5 is a view looking at the bottom of the head supplement portion;

FIG. 6 is a top view of a modified form of head supplement portion; and

FIG. 7 is a cross-sectional view, taken generally along the lines 7—7 in FIG. 1.

DETAILED DESCRIPTION OF THE PREFERRED EMBODIMENT

Referring now to the drawings, illustrated generally at 10 is a putter which includes a head 12 and a shaft 14 for the golf club extending upwardly from the head. Typically, the head includes a hosel 16 projecting upwardly from top 7 of the head and which provides a socket receiving the lower end of the shaft 14.

The hosel joins with the remainder of the head in the putter shown in a region substantially midway between the front face 18 of the putter head and the back side of the putter head, indicated at 20.

The head's bottom surface 24 is smooth and extends in substantially a plane over most of the length of the putter head. In the putter shown, at end extremities the bottom surface curves upwardly smoothly to extend into end surfaces of the head.

Detachably mounted on the putter head is what is referred to herein as a head supplement portion 30. The head supplement portion includes a body 34 and a pair of anchor projections 38, 40 joined to the body and projecting forwardly from front side 42 of the body. In the embodiment of the invention shown in FIGS. 1–3, body 34 has a base formed by a base surface 46 and a back side 48.

The back side of head 12 is formed with a pair of recessed wells 54, 56 provided at spaced points along the length of the head. The wells have an oblong cross section matching the oblong cross section of projection 38, 40, and are constructed snugly to receive these anchor projections. With the anchor projections fitting within the wells, and with body 34 snugly against the back side of the putter head, an established seated position is attained.

Detachable fasteners are utilized to secure the head supplement portion in this established seated position. More specifically, projecting upwardly into the head at spaced points along the bottom surface of the head are a pair of threaded bores 60, 62. These bores receive screws, such as screws 64, and ends of these screws are exposed on the bottom of the head.

The bottom sides of the anchor projections are provided with notches 66, each with a bottom surface 68 which has an inward incline on the anchor projection in a direction extending away from the front end of the projection. As a consequence, when a fastener or screw engages a notch, as shown in FIG. 7, with tightening of the screw and as the screw engages the inclined surface, there is a tendency for the projection to be drawn further inwardly with tightening of the supplement portion in its seated position.

Base surface 46 is smooth and is flat and has convexly curved ends which match the configuration of the bottom surface of the putter head. With the head supplement portion in place its base surface 46 forms a smooth continuation of bottom surface 24. In this way, the base of the supplement portion and the bottom surface of the putter head together form glide surfaces for the putter with the putter glided over the putting green.

The top of the head supplement portion is formed with a pair of downwardly indented recesses 72, 74. Between these recesses, at approximately a mid point of the supplement portion, is an indicator expanse 76.

With the supplement portion attached to the putter head, the golfer has the perception of an extended glide surface provided at the base of the putter. The indicator expanse may be employed as a visual aid to the golfer in making a smooth stroke which is truly perpendicular to the base of the putter head. The weight of the supplement portion increases the overall weight of the putter head assembly.

In FIG. 6 there is illustrated a modification of the invention. The supplement portion 80 illustrated has a top 82 which is flat and devoid of any recesses such as recesses 72, 74. With this supplement portion mounted against the rear side of the putter head, more weight is imparted to the overall head assembly than is the case with supplement portion 30.

The anchor projections and wells described constitute a form of mortise and tenon joint provided between the head supplement portion and the head of the club. The construction provides a secure mounting, with no looseness permitted such as might result in shifting of the supplement portion to a skewed position on the head. With the fasteners tightened, as already explained, the supplement portion is drawn further inwardly toward the head for the most secure fit.

While embodiments of the invention have been described, it should be obvious that modifications and variations are possible, and it desired to secure all such modifications and variations coming within the invention.

It is claimed and desired to secure by Letters Patent:

1. A golf club comprising:

a head having a bottom surface forming a bottom of the head, a shaft joined to the head and projecting upwardly therefrom, the head having a front and a face at the front of the head for striking a ball with swinging of the club, a back side of the head opposite the face and a well indented into said back side, a head supplement portion including a body overlying the back side of the club and at least one anchor projection projecting forwardly of the body, said body having a base surface extending along a base of the body forming a smooth substantially planar continuation of the bottom surface of the head rearwardly of said head, and faster means detachably securing the supplement portion to said head, said body having a top that faces upwardly and a pair of exposed recessed in said top disposed on either side of a raised indicator expanse separating said recesses.

2. The club of claim 1, wherein the back side of the head has multiple wells indented thereinto distributed along the length of the head, and said supplement portion has multiple anchor projections projecting forwardly from the body and fitted within respective wells, and which further includes a screw fastener mounted on said head securing the supplement portion in place, at least one of said anchor projection having a sloping cam surface engaged by said fastener and the slope of said surface producing a drawing of the supplement portion toward the head with tightening of the fastener.

3. A putter golf club comprising:

an elongate head element having essentially a flat substantially vertical front face and a back side opposite the front face and further including a top, and a bottom surface forming an exposed bottom of the head element, a hosel joined to and projecting upwardly from the head element at a point intermediate the front face and back side, an elongate head supplement element detachably mounted on the head element and fitting against the back side of the head element, and mortise and tenon means presented by the head supplement element and the head element interengaging to establish a predetermined position of the supplement element on said head element, said head supplement element having a base surface extending along a base thereof which forms a smooth substantially planar continuation of said bottom surface of said head element rearwardly of said head element, said head supplement element having an upwardly facing ridge located intermediate opposite ends of the element and located over the base surface of the element with said ridge providing an indicator expanse during swinging of the golf club.

4. The golf club of claim 3, wherein said mortise and tenon means comprises a tenon extending outwardly from one of said elements and a mortise indented inwardly into the other of said elements, and which further includes a detachable fastener mounted on said other element, said tenon having a sloping cam surface engaged by said fastener with the slope of said surface resulting in a drawing of the supplement element toward the head element with tightening of said fastener.

* * * * *